US007108025B2

(12) United States Patent
Bernhard

(10) Patent No.: US 7,108,025 B2
(45) Date of Patent: Sep. 19, 2006

(54) BEVERAGE BOTTLING PLANT FOR FILLING BOTTLES WITH A LIQUID BEVERAGE FILLING MATERIAL, AND A CONTAINER FILLING LIFTING DEVICE FOR PRESSING CONTAINERS TO CONTAINER FILLING MACHINES

(75) Inventor: Herbert Bernhard, Wolfsheim (DE)

(73) Assignee: KHS Maschinen- Und Anlagenbau AG, Dortmund (DE)

( * ) Notice: Subject to any disclaimer, the term of this patent is extended or adjusted under 35 U.S.C. 154(b) by 103 days.

(21) Appl. No.: 10/786,256

(22) Filed: Feb. 25, 2004

(65) Prior Publication Data

US 2004/0231288 A1 Nov. 25, 2004

(30) Foreign Application Priority Data

Feb. 26, 2003 (DE) ..... P 103 08 156

(51) Int. Cl.
*B65B 43/42* (2006.01)

(52) U.S. Cl. ..... 141/149; 141/144; 141/145; 141/172

(58) Field of Classification Search ..... 141/144–152, 141/162, 172, 177
See application file for complete search history.

(56) References Cited

U.S. PATENT DOCUMENTS 5,195,565 A * 3/1993 Owen et al. ..... 141/148
5,295,517 A * 3/1994 Ahlers ..... 141/1
5,370,163 A * 12/1994 Owen ..... 141/177
6,619,340 B1 * 9/2003 Kondo et al. ..... 141/152

FOREIGN PATENT DOCUMENTS

DE 39 19 565 A1 12/1990

* cited by examiner

*Primary Examiner*—Timothy L. Maust
(74) *Attorney, Agent, or Firm*—Nils H. Ljungman & Associates

(57) ABSTRACT

A beverage bottling plant for filling bottles with a liquid beverage filling material, and a container filling lifting device for lifting containers in container filling machines. The lifting device is designed to lift a container, such as a bottle, to a first level for filling in the absence of counter-pressure, and to a second, different level for filling under counterpressure.

20 Claims, 8 Drawing Sheets

BEVERAGE BOTTLING PLANT FOR FILLING BOTTLES WITH A LIQUID BEVERAGE FILLING MATERIAL, AND A CONTAINER FILLING LIFTING DEVICE FOR PRESSING CONTAINERS TO CONTAINER FILLING MACHINES

BACKGROUND

1. Technical Field

The present application in one aspect relates to a beverage bottling plant for filling bottles with a liquid beverage filling material, and a container filling lifting device for pressing containers to container filling machines.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus being configured to introduce a predetermined volume of liquid beverage filling material into the interior of bottles to a substantially predetermined level of liquid beverage filling material, and the apparatus configured to introduce a predetermined flow of liquid beverage filling material comprising apparatus being configured to terminate the filling of beverage bottles upon liquid beverage filling material reaching said substantially predetermined level in bottles. There may also be provided a conveyer arrangement being configured and disposed to move bottles, for example, from an inspecting machine to the filling machine. Upon filling, a closing station closes filled bottles. There may further be provided a conveyer arrangement configured to transfer filled bottles from the filling machine to the closing station; as well as a loading station that is configured to load filled bottles into containers, for example, in a six-pack arrangement. There may also be provided a conveyor arrangement configured to transfer filled bottles from the closing station to the loading station.

Container filling machines are preferably of a design of rotating machines that have a plurality of filling elements at their rotors. Support plates or support tables that can be raised and lowered are associated with the filling elements, which support tables receive the containers that are to be filled via input star wheels. Further, a so-called lifting device is associated with each of these support tables, the lifting device having the purpose of raising the containers that are disposed on the support tables towards the filling devices and to press the containers against the filling elements. In order to accomplish this function, these lifting devices generally comprise a combination of a fixed piston and a moveably disposed cylinder structure that surrounds the piston. The structural components are disposed vertically, and with the piston being rigidly connected to the rotor of the container filling machine. The cylinder can be moved up and down in a vertical direction. The cylinder chamber or cavity that is established between the fixed piston and the moveable cylinder, is in most cases impacted by compressed air, the compressed air being passed through a bore within the piston, such that the cylinder has the disposition to move in a vertical direction to an upper position. This movement is limited by a roller that is secured to the cylinder, which roller is configured to rotate about its longitudinal axis, with the roller contacting a curved path of a stationary cam structure. By way of the rotating movement of the rotor of the container filling machine, the roller rolls upon the curved path of the cam structure, that is, it follows the course of the curved path of the cam structure and simultaneously carries out an upwardly directed movement and a downwardly directed movement, which movements, due to the configuration of the design of the machine, are also carried out by the support table and, accordingly, a container supported on a support table.

In most cases, the curved path of such cam structures is not disposed along the entire circumferential surface area or region of the rotor, but they rather extend only along a portion of the circumference, preferably in the region of the container inlet and the container outlet, where the receiving surface of the support table needs to be disposed at the level of the transport structures that supply containers and also remove containers.

Such a lifting device has been proposed, for example, in German Patent No. DE 39 19 565. The embodiment described in this reference has the disadvantage that the stroke of the lifting device is determined exclusively by the contour provided by the curved path of the cam structure and changes of the movement of the stroke can only be accomplished by an exchange of the cam structure, this being a very time-consuming effort and, consequently, expensive in practical operation.

German Patent No. DE 39 19 565 and its corresponding Published European Patent Application No. EP 0 402 643 published on Jun. 15, 1989 are hereby incorporated by reference as if fully set forth in their entirety herein.

Within the scope of the efforts of lowering the cost, in the beverage industry there arises increasingly the problem to fill, with the same filling machine, containers with beverage liquids of great variety. Aside from the option to adapt the individual method steps of the filling procedure to the requirements of the filling material, the users also demand the option to select in simple manner between the method of filling under counterpressure and the method of filling in the absence of pressure.

The essential difference between the two filling methods is the connection between the filling element and the container that is to be filled during filling.

When counterpressure filling is to be utilized, the filling device and the container are disposed in sealed manner with respect to one another; this means that the container is pressed with a considerable force against the filling device, so as to ensure that the interior of the container is secured in a gas-tight manner against the ambient. This filling method is used primarily for carbon dioxide containing beverages, such as, for example, beer or mineral water. For filling in the absence of pressure, in turn, the filling devices and the container are not disposed in a sealed relationship with respect to one another, but they are rather disposed at a distance with respect to one another. This filling method applies to beverages that are free of carbon dioxide, such as, for example, fruit juices or milk.

Since the length of the stroke of a lifting device is essentially constant, the achievement of such a function, i.e., the option to select between counterpressure filling of an effervescent beverage, such as, beer, and filling of a still beverage in the absence of counterpressure, such as, for example milk, requires implementation of a special structural design.

To provide a solution to such a problem, the state of the art comprises the suggestion in which use is made of a lifting device comprising a stationary cylinder and a moveable piston, with the respective piston rod extending beyond each end of the cylinder. The support table is secured to the upper end of the piston rod, and an abutment plate is secured to the lower end of the piston rod. When a pressure filling is carried out, this abutment plate is idle, and the piston rod can move in upward direction until the container and the filling element are disposed in sealed relationship with respect to one another. In order to carry out filling in the absence of pressure, a spacer element is disposed at the lower end of the piston rod, anteriorly with respect to the abutment plate. Because this spacer element is disposed to reduce the length of travel of the abutment plate, or, respectively, the effective length of the lower portion of the piston rod is reduced, and the length of the stroke of the piston is effectively limited. This procedure has the considerable time disadvantage when the spacer elements have to be replaced, particularly in the case of filling machines that have many filling positions.

A further attempt to provide a solution comprises the design in which the filling machine vessel is configured to be adjusted with respect to height, i.e., it can be raised and lowered, so that establishing of a sealed condition, at constant stroke of the lifting elements can also be influenced. Such a solution is mechanically very demanding and, consequently, expensive.

OBJECTS

One object of an embodiment described below is to solve the problems encountered on similar apparatus of the prior art.

It is also an object of an embodiment described below to accomplish remedy and improvement and to suggest an arrangement that avoids the mentioned disadvantages, and, nevertheless, allows a simple selection between filling in the absence of pressure and counterpressure filling.

SUMMARY

One feature or aspect of an embodiment is believed at the time of the filing of this patent application to possibly reside broadly in a beverage bottling plant for filling bottles with a liquid beverage filling material, said beverage bottling plant comprising: a filling machine being configured to fill empty bottles with liquid beverage filling material; a conveyer arrangement being configured and disposed to move empty bottles to said filling machine; said filling machine comprising a rotor having a peripheral portion; said filling machine defining a vertical axis about which said rotor is configured to rotate; said beverage filling machine comprising a plurality of beverage filling positions disposed about said peripheral portion of said rotor; each beverage filling position comprising a beverage filling device for filling bottles with liquid beverage filling material; each filling device comprising apparatus being configured to introduce a predetermined volume of liquid beverage filling material into the interior of bottles to a substantially predetermined level of liquid beverage filling material; said apparatus being configured to introduce a predetermined volume of liquid beverage filling material comprising apparatus being configured to terminate the filling of beverage bottles upon liquid beverage filling material reaching said substantially predetermined level in bottles; each filling position comprising a support configured and disposed to maintain a bottle in a predetermined position for filling a by a corresponding filling device; each filling position comprising an arrangement to seal a bottle for filling a bottle with an effervescent beverage; apparatus being configured to raise and to lower said bottle support and a bottle supported thereby; said apparatus being configured to raise and lower said bottle support comprising: a rod having a first, lower, end and a second, upper, end remote from said lower end; said lower end of said rod being secured to said rotor of said filling machine; a cylinder having a longitudinal axis and having outer and inner walls disposed about the longitudinal cylinder axis; said inner cylinder wall being configured and disposed to slide on said rod to permit up-and-down movement of said cylinder; said cylinder having a first, upper, end and a second, lower, end remote from said upper end of said cylinder; said bottle support being secured to said upper end of said cylinder to permit raising and lowering of said bottle support and a bottle supported thereby; a collar secured to said lower end of said cylinder; a first, upper, stop structure secured to said rotor of said filling machine adjacent said upper end of said rod; said cylinder outer wall being configured to slide within said upper stop structure; a second, lower, stop structure operatively connected to said upper stop structure and being configured and disposed to slide on said outer cylinder wall; a spring disposed between said upper stop structure and said lower stop structure and being configured to be compressed between said upper stop structure and said lower stop structure; said rod comprising a longitudinal bore configured to permit passage of a pressure medium from said lower end of said rod into said cylinder; said cylinder being configured to be raised by a first, lower, pressure of a pressure medium passing through said longitudinal bore of said rod and thus raising said bottle support and a bottle supported thereby to a first, lower, position being a position in which a bottle is disposed remote from said seal arrangement which lower position is configured for filling of a bottle with a still beverage; said cylinder being configured to be raised by a second pressure, being a pressure higher than the first pressure, of a pressure medium passing through said longitudinal bore of said rod and thus raising said bottle support and a bottle supported thereby to a second, higher, position being a position in which a bottle is sealed to said sealing arrangement which higher position is configured for filling of a bottle with an effervescent beverage; said collar being configured to be disposed against said lower stop structure to maintain said bottle support and a bottle supported thereby in the lower position upon the lower pressure being applied in said cylinder; said spring being configured and disposed to be compressed between said upper stop structure and said lower stop structure by said collar upon the higher pressure being applied in said cylinder to permit raising of said bottle support and a bottle supported thereby to the higher position.

Another feature or aspect of an embodiment is believed at the time of the filing of this patent application to possibly reside broadly in a beverage bottling plant for filling bottles with a liquid beverage filling material, said beverage bottling plant comprising: a filling machine being configured to fill empty bottles with liquid beverage filling material; a conveyer arrangement being configured and disposed to move empty bottles to said filling machine; said filling machine comprising a rotor having a peripheral portion; said filling machine defining a vertical axis about which said rotor is configured to rotate; said beverage filling machine comprising a plurality of beverage filling positions disposed about said peripheral portion of said rotor; each beverage filling position comprising a beverage filling device for filling bottles with liquid beverage filling material; each filling device comprising apparatus being configured to introduce a predetermined volume of liquid beverage filling material into the interior of bottles to a substantially predetermined level of liquid beverage filling material; said apparatus being configured to introduce a predetermined volume of liquid beverage filling material comprising apparatus being configured to terminate the filling of beverage bottles upon liquid beverage filling material reaching said substantially predetermined level in bottles; each filling position comprising a support configured and disposed to maintain a bottle in a predetermined position for filling a by a corresponding filling device; apparatus being configured to raise and to lower said bottle support and a bottle supported thereby, said lifting apparatus comprising: a chamber configured to receive a pressure medium; a stop structure being configured to permit a plurality of stroke lengths of said lifting apparatus depending upon the pressure exerted by the pressure medium in said chamber to raise said bottle support and a bottle supported by said bottle support, adjacent a-filling device, to at least two predetermined levels.

A further feature or aspect of an embodiment is believed at the time of the filing of this patent application to possibly reside broadly in a container filling plant container lifting apparatus configured to raise and to lower a container support and a container supported thereby in a container filling machine having a plurality of filling elements, said lifting apparatus comprising: a chamber configured to receive a pressure medium; a stop structure being configured to permit a plurality of stroke lengths of said lifting apparatus depending upon the pressure exerted by the pressure medium in said chamber to raise said container support and a container supported by said container support, adjacent a filling element, to at least two predetermined levels.

Still another feature or aspect of an embodiment is believed at the time of the filing of this patent application to possibly reside broadly in that the lifting devices are impacted by different operating pressures, and that the lifting devices are additionally equipped with an abutment element that can be subjected to the force of a spring and that is configured to be shifted, and that can conclude the strokes of the lifting devices, when use is made of a first, lower, operating pressure, at a first, lower position; and that can conclude the strokes of the lifting devices, when use is made of a second, higher operating pressure, at a second, higher, position.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Embodiments are further described in greater detail with reference to the accompanying drawings.

DESCRIPTION OF EMBODIMENTS

Figure 1:
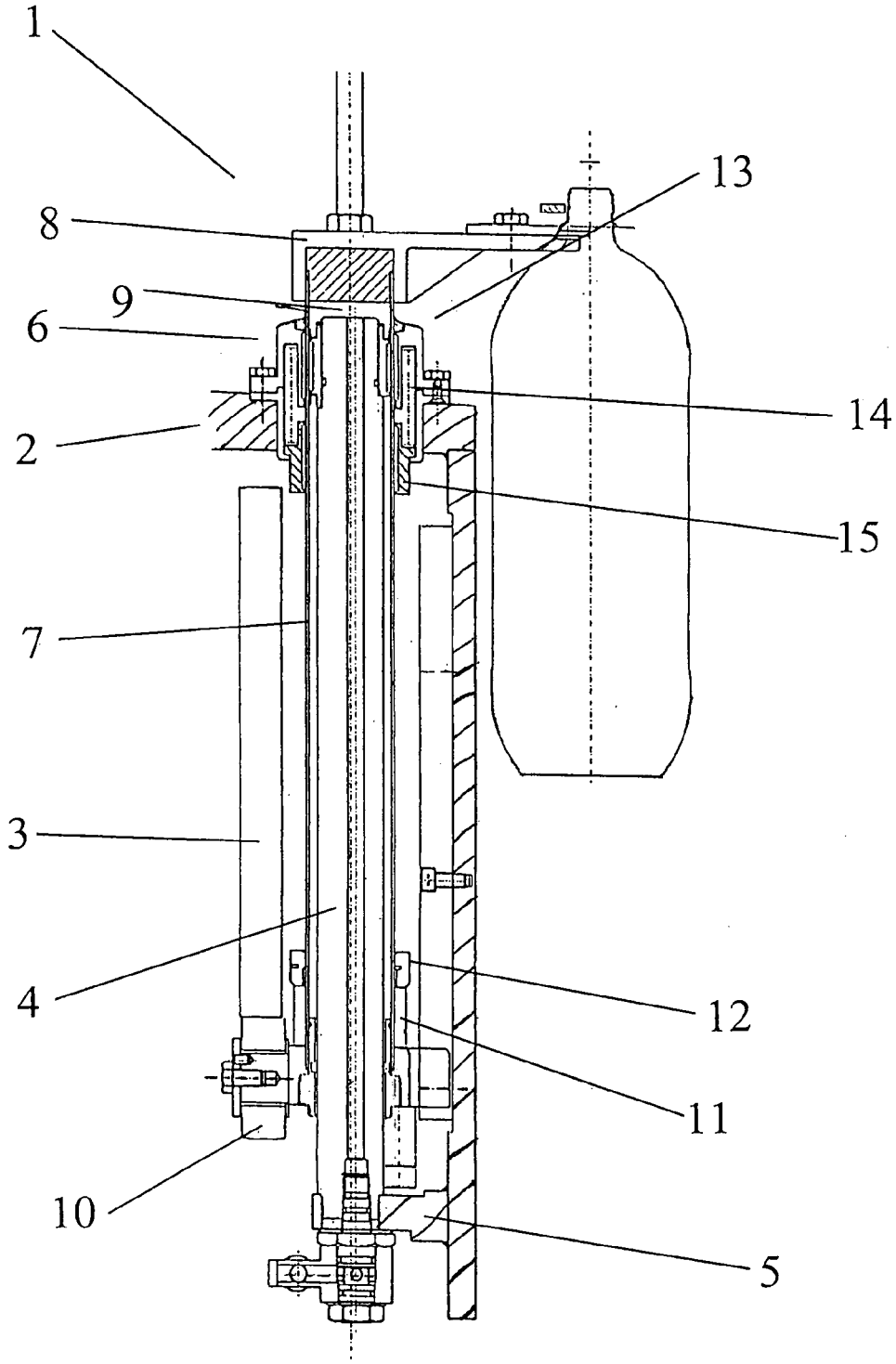
FIG. 1 shows a cross-sectional illustration of a lifting device in accordance with one embodiment of the present application, that is shown in the retracted state.
Figure 1A:
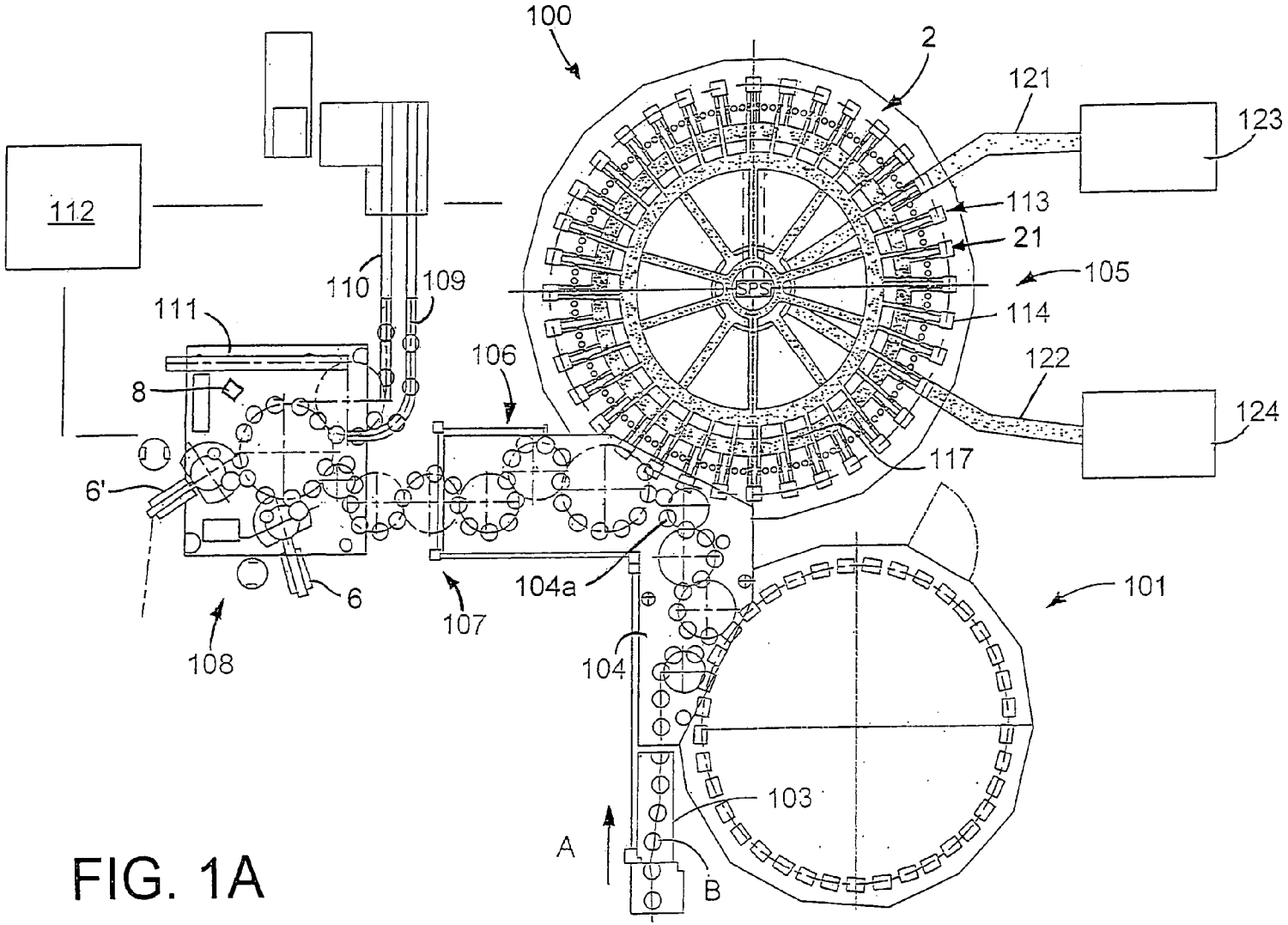
FIG. 1A is a schematic illustration of a container filling plant in accordance with one embodiment of the present application.

FIG. 1A shows schematically the main components of one embodiment example of a system for filling containers, specifically, an embodiment of a beverage bottling plant 100 for filling bottles B with liquid beverage filling material, in accordance with one embodiment, or in which system or plant could possibly be utilized at least one aspect, or several an aspects, of the embodiments disclosed herein.

FIG. 1A shows a rinser or rinser station 101, to which the containers, namely bottles B, are fed in the direction of travel as is indicated by the arrow A, by means of a conveyer line or conveyer arrangement 103, and downstream of rinser station 101, in the direction of travel as is indicated by the arrow A, the rinsed bottles B are transported to a beverage filling machine 105 by means of a conveyer line or conveyer arrangement 104 that is formed, for example, by a star wheel conveyer or a plurality of star wheels of a conveyer arrangement. The conveyer arrangement 104 may possibly have a star wheel 104*a* that introduces bottles B to the filling machine 105.

Downstream of the filling machine 105, in the direction of travel of the bottles B, there can preferably be a closer or closer station 106 which closes the bottles B.

The closer or closer station 106 can, for example, be connected directly to a labeling device or labeling station 108, such as, for example, by means of a conveyer line or conveyer arrangement 107 that may be formed, for example, by a plurality of star wheels of a conveyer arrangement.

In the illustrated embodiment, the labeling device or labeling machine or labeling station 108 has, for example, three outputs, namely one output formed by a conveyer or conveyer arrangement 109 for bottles B that are filled with a first product. The first product may possibly be provided by a product mixer 123 that is connected to the filling machine 105, for example, through a conduit 121, and bottles B that are filled with a predetermined volume of liquid beverage filling material, that is, the first product, are then labeled by a labeling module 6 in the labeling stations 108 corresponding to this first product delivered from product mixer 123 to the beverage filling machine 105 and thence to the corresponding bottles B.

A second output that is formed by a conveyer or conveyer arrangement 110 is provided for those bottles B that are filled with a second product. The second product may emanate from a second product mixer 124 that is connected, for example, through a conduit 122 to the filling machine 105, and these bottles B filled with a predetermined volume of liquid beverage filling material comprising the second product are then correspondingly labeled by a labeling module 6' in the labeling station 108 corresponding to this second product.

A third output, for example, formed by a conveyer or conveyer arrangement 111, removes any bottles B which have been incorrectly labeled as may have been determined by an inspecting device or an inspecting station, or an inspecting module 8 that may possibly form a part of the labeling station 108.

In FIG. 1A item 112 is a central control unit or, expressed differently, a controller or a system which includes a process controller that, among other things, controls the operation of the above-referenced system or plant.

The beverage filling machine 105 is preferably of the revolving design, with a rotor 2, which revolves around a vertical machine axis. On the periphery of the rotor 2 there are a number of filling positions 113, each of which comprises bottle carriers or container carriers or container supports 21 that are configured and disposed to present bottles B for filling, as well as a filling device or element or apparatus 114 located or configured to be located above the corresponding container carrier 21 and the corresponding bottle B presented by the carrier or support 21. The filling device or apparatus 114 comprises an apparatus configured to introduce a predetermined volume of liquid beverage filling material into the interior of bottles B to a predetermined level of liquid beverage filling material. Furthermore, the filling device or apparatus comprises an apparatus configured to terminate the filling of bottles upon liquid beverage filling material reaching the predetermined level in bottles B. In other words, filling elements 114 are configured and disposed to provide a predetermined flow of liquid beverage filling material from the source thereof, such as, product mixers 123 and 124, into the bottles B.

The toroidal vessel 117 is a component, for example, of the revolving rotor 2. The toroidal vessel 117 can be connected by means of a rotary coupling or a coupling that permits rotation, and by means of an external connecting line 121 to the external reservoir or product mixer 123 to supply the product, that is, product mix one, for example.

As well as the more typical filling machines having one toroidal vessel, it is possible that in at least one possible embodiment a filling machine could possibly be utilized wherein each filling device 114 is preferably connected by means of two connections to a toroidal vessel 117 which contains a first product, say by means of a first connection, for example, 121, and to a second toroidal vessel which contains a second product, say by means of the second connection, for example, 122. In this case, each filling device 114 can also preferably have, at the connections, two individually-controllable fluid or control valves, so that in each bottle B which is delivered at the inlet of the filling machine 105 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

As illustrated in FIG. 1, the lifting devices 1 are arranged about the circumference of the rotor 2 of a container filling machine. The central component of the lifting device 1 is the piston 4 that is fixedly secured to the rotor 2 by way of a support structure 5. The piston 4 is surrounded by a cylinder 6 that comprises a cylindrical tube 7 and also a cylinder head 8. The lifting stroke chamber 9 resulting between the piston 4, cylindrical tube 7 and cylinder head 8 is impacted with compressed air that is passed through a bore disposed within the piston rod 4. The resulting upwardly directed movement of the cylinder 6 is limited and controlled by way of a roller 10 that is secured to the cylinder 6, the roller 10 being journalled to permit its rotation and also this roller 10 being in contact at the curved path of cam structure 3.

An abutment element 12 is secured to the periphery of the cylinder 6 at its lower end, particularly by way of a spacer element 11.

At the upper end of the cylinder 6 there is provided an element 13 that is configured to receive and to guide, as will be explained in greater detail below. The receive-and-guide element 13 is configured in such a way that in addition to its guiding function it can accomplish other functions. Thus, the receive-and-guide element 13 comprises a spring-receiving chamber 14 and a stop sleeve 15 that is moveably disposed between the cylindrical tube 7 and the receive-and-guide element 13.

A cylindrical coil spring 16 can be disposed within the spring-receiving chamber 14. In further developments or embodiments, other elastic elements may be employed, such as, for example, elastically, resilient, plastic/synthetic elements, or a plurality of coil springs that are disposed at the circumference of the spring-receiving chamber 14, or other means that are known in the art and that are suitable for use in the present embodiments of the application.

By means of the coil spring 16 that is disposed with pretension in the spring-receiving chamber 14, the stop sleeve 15 that is essentially guided by the cylindrical tube 7, is moved in downward direction until this stop sleeve 15 is pressed, due to its geometrical configuration, against an abutment of the receive-and-guide element 13. In this position the lower end of the stop sleeve 15 extends markedly beyond the lower limit of the receive-and-guide element 13.

The following describes the procedure of a first filling method, in which the containers are filled in the absence of pressure, that is, the containers are not disposed in sealed contact at the filling valve.

So as to employ this method, the lifting stroke chamber 9 is impacted with a first, low, pressure. During the rotational movement of the rotor 2 about its vertical axis, the cylinder 6 follows, due to the roller 10 being in contact with the curved path of the cam structure 3, the prescribed up-and-down movement. Once the rotor has achieved a predetermined angle of rotation, the curved path of the cam structure terminates in a continuous run-out. As a rule, prior to reaching this run-out, the cylinder 6 has moved so far in upwardly direction, such that the abutment element 12 is in contact with the stop sleeve 15 and, accordingly, can not move further in upward direction. The pressure that is employed in this method is not sufficient to compress the coil spring 16 that is disposed in the spring-receiving chamber 14, the upwardly directed movement of the lifting device accordingly is terminated in this position, and the container is not in sealed contact with the filling element.

In a second filling method, a method that employs counterpressure filling, the lifting stroke chamber 9 is impacted with a second, higher, pressure. This means that the abutment element 12, that is secured to the cylindrical tube 7, is pressed by a greater force against the stop sleeve 15. Once the roller 10 has left the course of the curved path of cam structure 3 and in the event that the pressure impacting on lifting stroke chamber 9 is sufficiently great, the abutment element 12 is in a condition to compress the coil spring by a shift of the stop sleeve 15 to such an extent until the stop sleeve 15 contacts the upper portion of the spring-receiving chamber 14. This results in a lengthening of the stroke of the cylinder 6, accordingly, the container is in sealed contact with the filling element.

Figure 2:
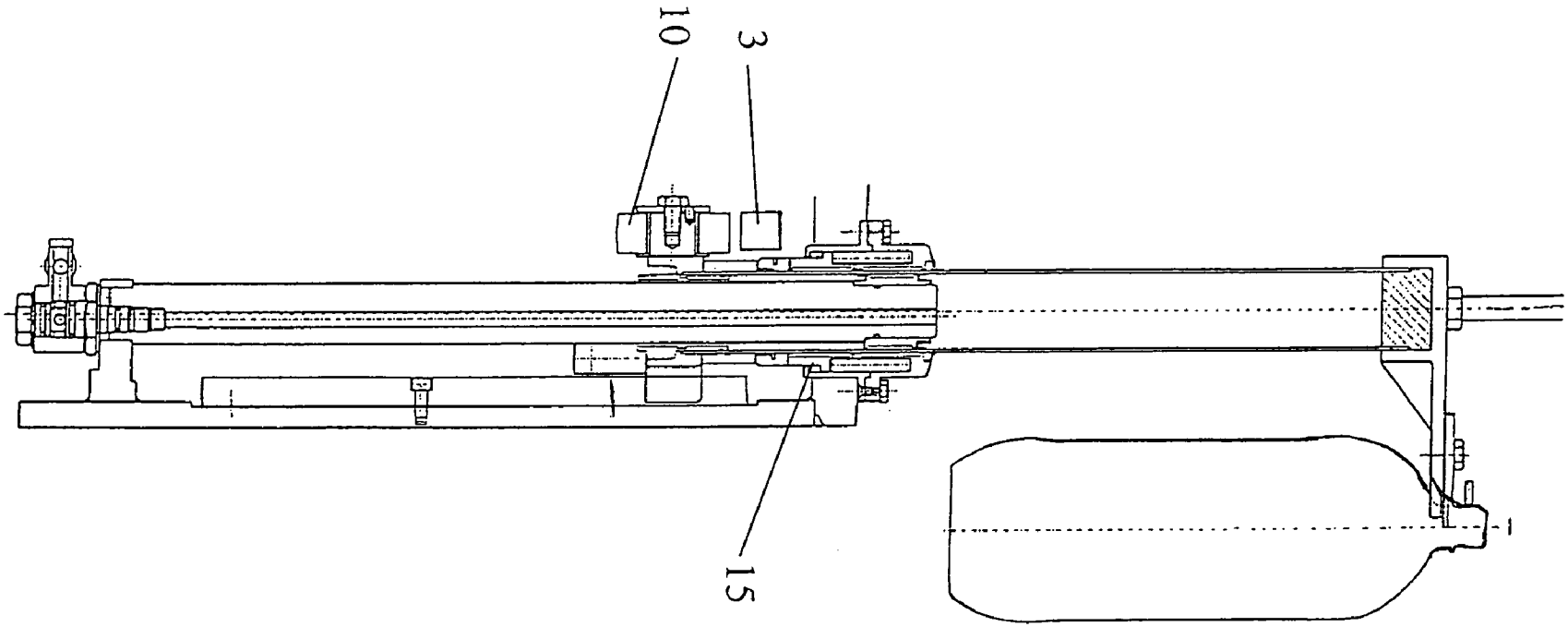
FIG. 2 shows a cross-sectional illustration of a lifting device in accordance with one embodiment of the present application, that is shown in the extended state.
Figure 3:
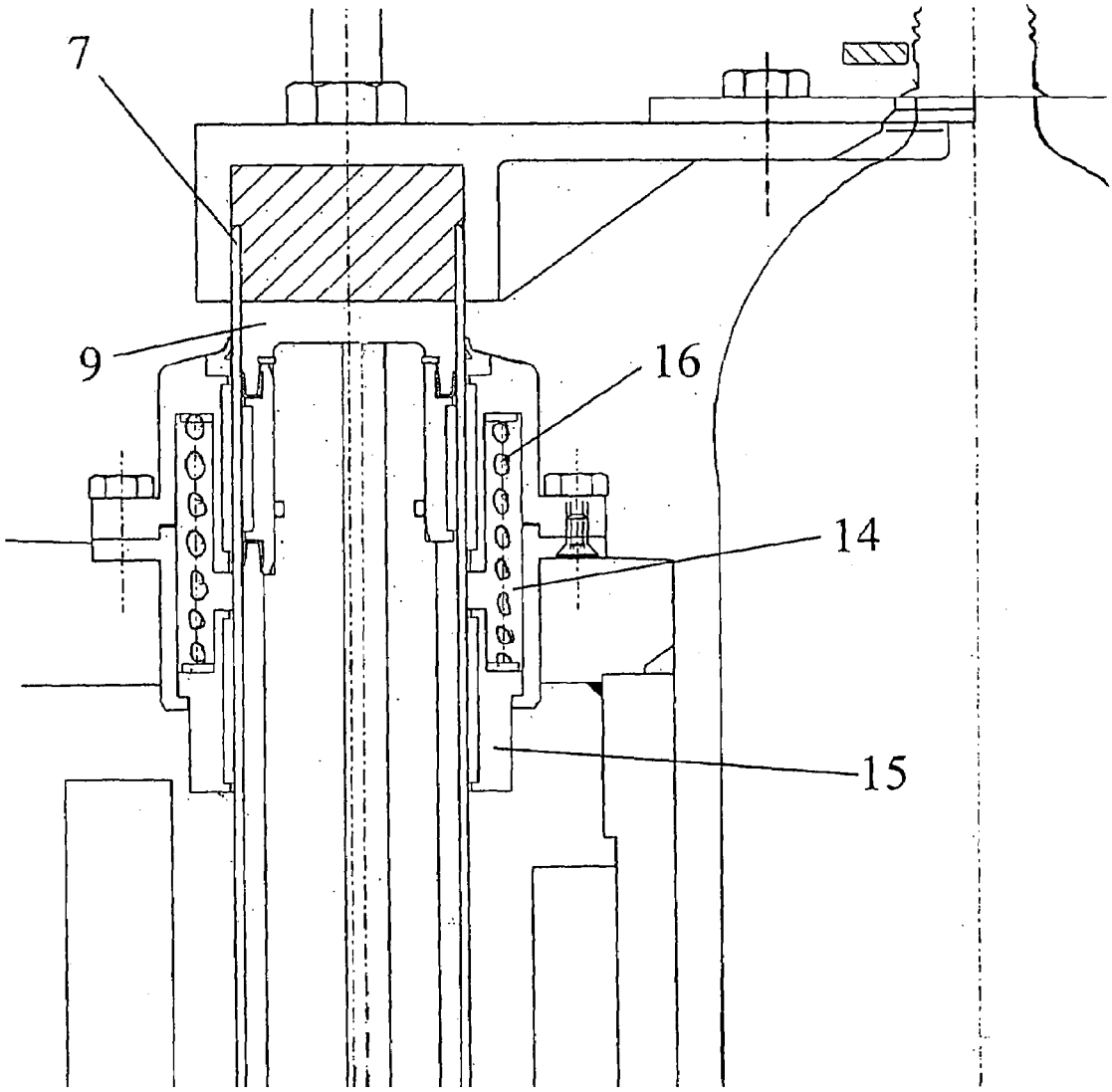
FIG. 3 is a detail view that shows the spring loaded abutment of a lifting device in accordance with one embodiment of the present application.

This situation is illustrated in FIG. 2.

In a further highly advantageous embodiment, provision is made to employ hydraulic and/or pneumatic functional elements, or, respectively, spring elements. These elements can comprise a cylinder and a piston having a piston rod, such that the piston rod is to serve as the abutment for the moveable lifting device. When the lifting device moves against the piston rod, a corresponding pressure is built up in the cylindrical chamber of the element. When the magnitude of the pressure exceeds a predetermined value, a pressure relief valve opens and the pressure medium present in the cylindrical chamber can escape, which means that the piston can be driven in further, this, in turn, having the consequence of an increase of the stroke of the lifting device. In the event that the lifting device retracts, within the continuously advancing rotational movement of the rotor, a spring element that is disposed in and/or at the device, returns the piston again to its starting position. When the pressure, in a second filling method, in the cylinder chamber is below the value that is required for opening of the pressure limiting valve, the piston can not be driven into the cylinder beyond a predetermined, low, amount, this limiting the stroke of the lifting device.

The pressure medium utilized within the element described above can be, in conformity with the variant, a gas or a hydraulic liquid.

Figure 4:
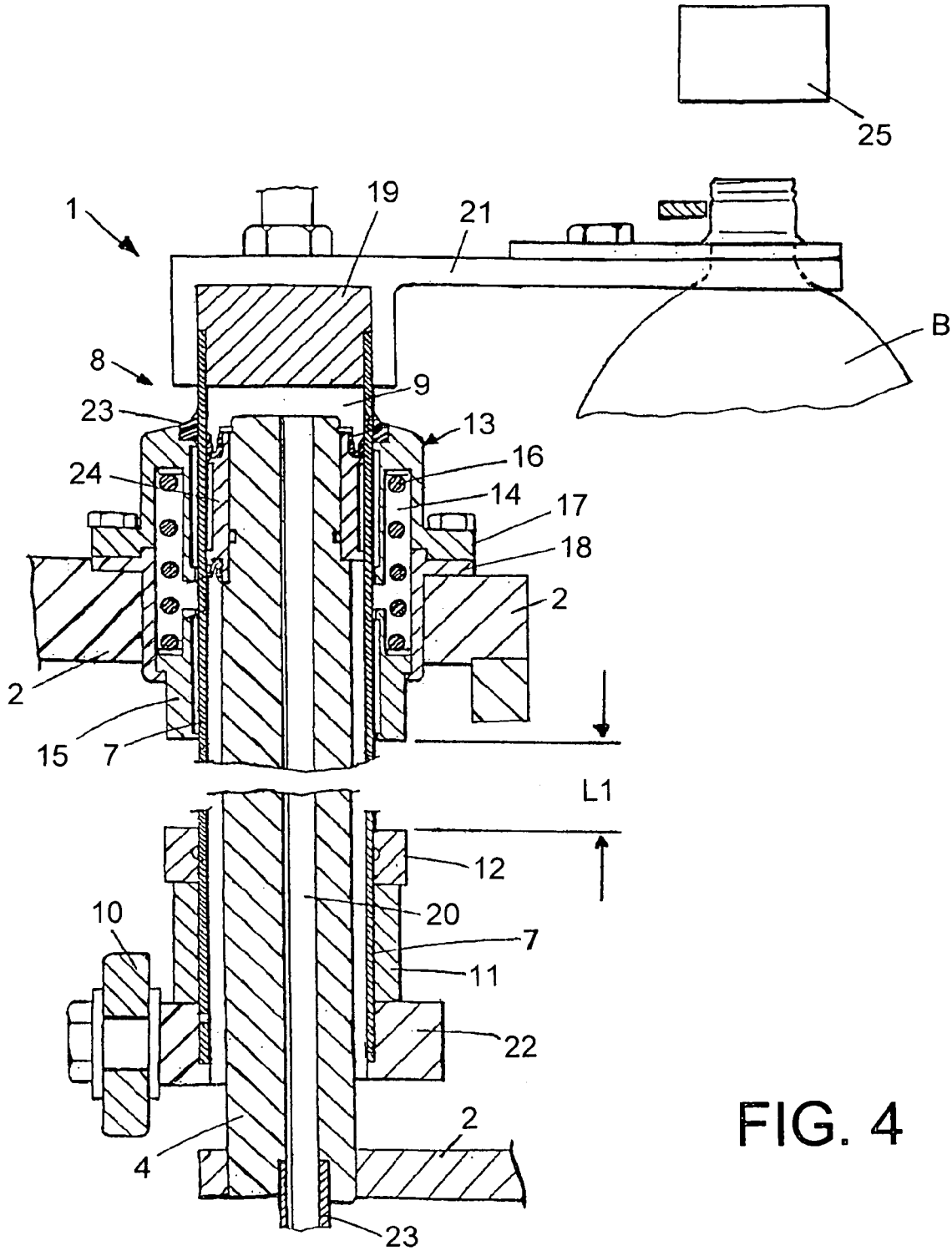
FIG. 4 is a cross-sectional representation of the lifting device in accordance with one embodiment of the present application in the rest position.

With reference to FIG. 4, the rod 4 is secured to rotor 2. Rod 4 has a longitudinal passage 20 that has a connection 23 to a supply of compressed air, for example. The roller 10 is secured to the lower end of cylinder 7 and a guide structure 22 that guides the cylinder 7 in a guide structure, not shown, but being part of rotor 2, upon up-and-down movement of the cylinder 7 is also disposed at the lower end of cylinder 7. The spacer element 11 and collar 12 are disposed near the lower end of the cylinder 7. In the position shown in FIG. 4, the fixed collar 12 is a distance L1 away from the stop sleeve 15. Stop sleeve 15 is part of a stop arrangement that comprises receiving-and-guiding element 13 that forms the housing 14 for spring 16. Thus, receiving-and-guiding element 13 comprises an upper component or stop structure 17 and a lower component or stop structure 18 that together are suitably secured to rotor 2 of the filling machine. The inner cylinder wall is configured and disposed to slide on the rod 4, particularly on the piston member 24 thereof to permit up-and-down movement of the cylinder 7.

Bottle support table or support 21 is secured to the upper end of the cylinder 7 so as to permit raising and lowering of the bottle support 21 and a bottle B supported thereon, when pressure is exerted upon the end-plug 19 that connects bottle support 21 to the upper end of cylinder 7.

Thus, the upper stop structure 17 is secured to rotor 2 of the filling machine adjacent the upper end of the rod 4 and the cylinder outer wall being configured to slide within the upper stop structure 17, say by intervention of a seal 23. The lower stop structure 15 is operatively connected to the upper stop structure 17 and is configured and disposed to slide on the outer wall of cylinder 7.

Spring 16 is disposed between the upper stop structure 17 and the lower stop structure or stop sleeve 15 and is configured to be compressed between the upper stop structure 17 and the stop sleeve 15.

Upon a pressure medium passing with a first, low, pressure through the longitudinal bore 20 of rod 4 into the cylinder chamber 9, the cylinder 7 is raised and thus, in turn, raises the bottle support 21 and a bottle B supported thereon to a first position, this being a position in which a bottle B is disposed away from a seal arrangement 25, which first position is configured to permit filling of a bottle B with a still beverage, for example, milk. The stroke of the cylinder 7 to attain the first position, is indicate as length L1 in FIG. 4. It will be appreciated that the force of the spring and the low pressure preclude further raising of cylinder 7 since the collar 12 is in abutment with the stop sleeve 15 and maintains the cylinder 7 and thus the bottle support 21 and a bottle B supported thereon in the first position. This condition or position is illustrated in FIG. 5.

Upon a pressure medium passing with a second, high, pressure through the longitudinal bore 20 of rod 4 into the cylinder chamber 9, the cylinder 7 is raised by distance L2 and thus, in turn, raises the bottle support 21 and a bottle B supported thereon to a second position, this being a position in which a bottle B is sealed to the sealing arrangement 25, which second position is configured to permit filling of a bottle B with an effervescent beverage, for example, beer.

Figure 5:
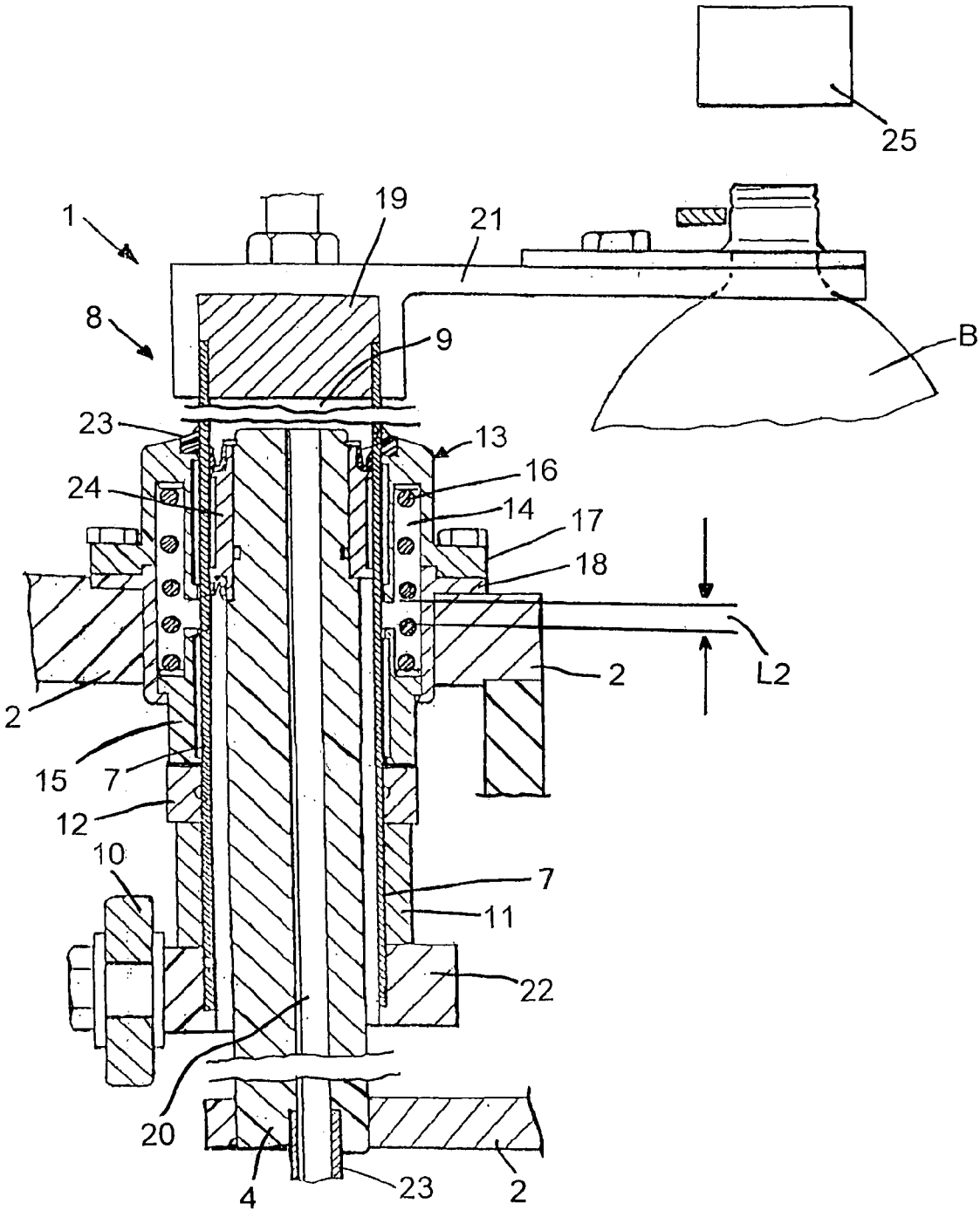
FIG. 5 is a cross-sectional representation of the lifting device in accordance with one embodiment of the present application in the first raised position wherein a container is raised to a first level for filling with a still beverage.
Figure 6:
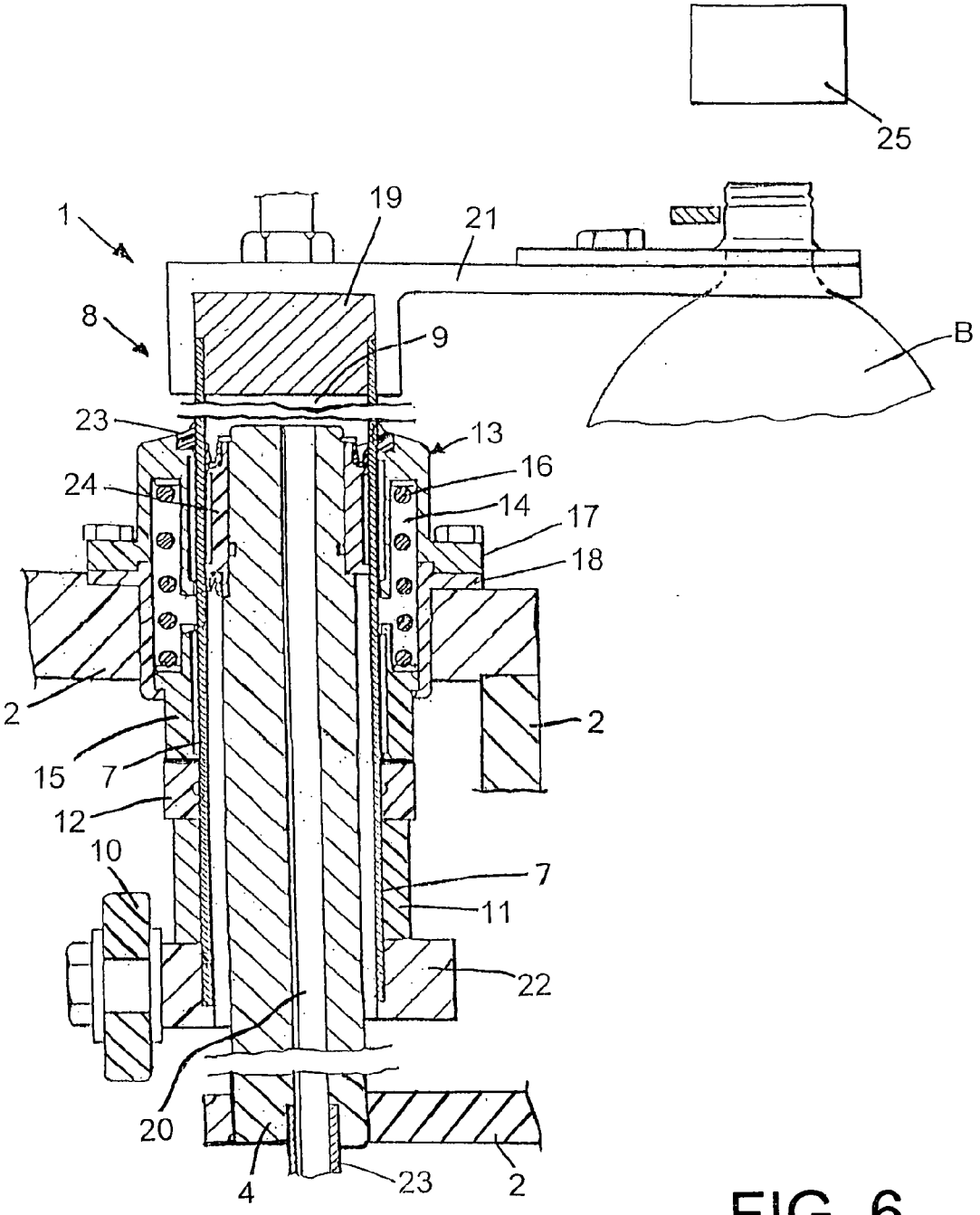
FIG. 6 is a cross-sectional representation of the lifting device in accordance with one embodiment of the present application in the second raised position wherein a container is raised to a second level for filling of an effervescent beverage by counterpressure.

So as to attain the second position, the spring 16 is compressed by the receiving-and-guiding element 13 and the stop sleeve 15; compare FIG. 6 in which the stop sleeve 15 has risen by the distance L2, that is shown in FIG. 5, due to the force that is generated by the collar 12 bearing on stop sleeve 15.

Figure 7:
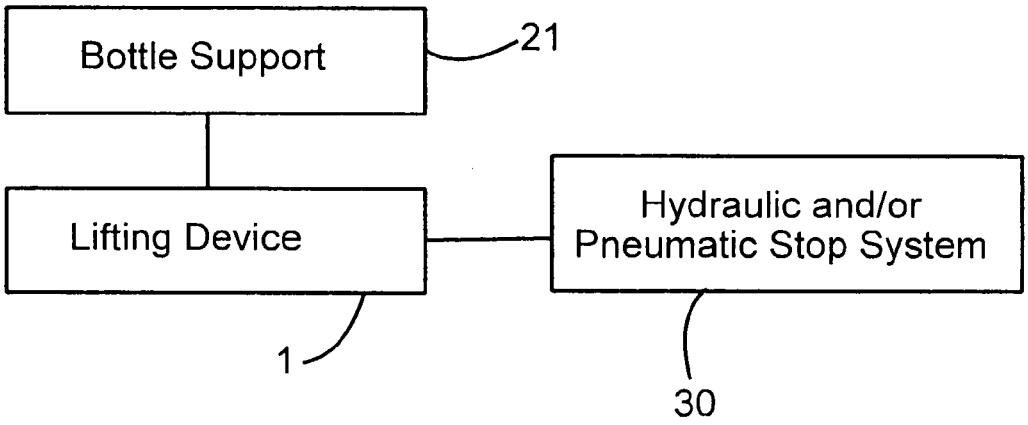
FIG. 7 is a schematic illustration of a another embodiment of the present application.

With reference to FIG. 7, provision is made to employ hydraulic and/or pneumatic functional elements 30, or, respectively, spring elements. These elements can comprise a cylinder and a piston having a piston rod, such that the piston rod is to serve as the abutment for the moveable lifting device 1. When the lifting device 1 moves, due to roller 10 engaging the cam structure 3, against the piston rod, a corresponding pressure is built up in the cylindrical chamber of the cylinder. When the magnitude of the pressure exceeds a predetermined value, a pressure relief valve opens and the pressure medium present in the chamber of the cylinder can escape, which means that the piston can be moved up further, this, in turn, having the consequence of an increase of the stroke of the lifting device 1.

In the event that the lifting device 1 retracts to the starting level, within the continuously advancing rotational movement of the rotor, a spring element that is disposed in and/or at the device, returns the piston again to its starting position.

When the pressure, in a second filling method, in the chamber of the cylinder is below the value that is required for opening of the pressure limiting valve, the piston can not advance into the cylinder beyond a predetermined, low, amount of pressure of a pressure medium, this limiting the stroke of the lifting device 1.

The application relates in one aspect to a lifting device that is configured to perform a variable stroke, for container processing machines, particularly for machines for filling containers, with the lifting devices being disposed in circular manner and at a distance with respect to one another at the lifting device table.

One feature or aspect of an embodiment is believed at the time of the filing of this patent application to possibly reside broadly in the lifting device, configured to perform a variable stroke, for container processing machines, particularly at machines for filling containers, with the lifting devices being disposed in circular manner and at a distance with respect to one another at the lifting device table, onto each lifting device is secured a support table, and each lifting device comprises a conduit, for a pressure medium, which conduit is guided into the chamber of the lifting device, characterized in that at and/or within the lifting device there are provided abutment means which are configured to permit a respectively varied stroke position, in conformity with the pressure exerted by the pressure medium.

Another feature or aspect of an embodiment is believed at the time of the filing of this patent application to possibly reside broadly in the lifting device characterized in that the abutment means comprise at least one abutment element 15 that is configured to be subjected to the force of a spring, and said abutment element is capable to assume at least two defined position, in conformity with the force that is impacting on said abutment element.

Yet another feature or aspect of an embodiment is believed at the time of the filing of this patent application to possibly reside broadly in the lifting device characterized in that the abutment elements are disposed at least in part within a chamber for a spring element 14.

Still another feature or aspect of an embodiment is believed at the time of the filing of this patent application to possibly reside broadly in the lifting device characterized in that the elements that are configured to produce the force of a spring comprise at least one coil spring.

A further feature or aspect of an embodiment is believed at the time of the filing of this patent application to possibly reside broadly in the lifting device characterized in that the elements that are configured to produce the force of a spring comprise any desired spring elements made of plastic, metal, or another material.

Another feature or aspect of an embodiment is believed at the time of the filing of this patent application to possibly reside broadly in the lifting device characterized in that the elements that are configured to produce the force of a spring comprise hydraulic and/or pneumatic operating functional elements.

A further feature or aspect of an embodiment is believed at the time of the filing of this patent application to possibly reside broadly in the lifting device characterized in that the abutment means are configured to limit the stroke of the lifting element in conformity with the pressure of the pressure medium.

Another feature or aspect of an embodiment is believed at the time of the filing of this patent application to possibly reside broadly in a container filling plant container lifting apparatus configured to raise and to lower a container support and a container supported thereby in a container filling machine having a plurality of filling elements, said lifting apparatus comprising: a rod being configured to be connected to and to rotate with said filling machine; a cylinder having inner and outer walls disposed about said rod; said inner cylinder wall being configured and disposed to slide on said rod to permit up-and-down movement of said cylinder; said cylinder having an upper end and a lower end remote from said upper end of said cylinder; a container support being secured to said upper end of said cylinder to permit raising and lowering of said container support and a container supported thereby; a collar secured to said lower end of said cylinder; a stop arrangement being configured to stop movement of said collar and said cylinder; said cylinder being configured and disposed to slide within said stop arrangement; a passage configured to permit a pressure to enter into said cylinder to raise said cylinder; said collar being configured to be disposed against said stop upon a first, lower, pressure of a pressure medium passing through said passage of said rod and thus positioning said container support and a container supported thereby at a first, lower, position or level; a biasing member being configured to be disposed against said stop and to be compressed by said collar; said collar being configured to be raised, upon a second, higher, pressure of a pressure medium passing through said passage and thus compressing said biasing member and thus raising said container support and a container supported thereby, to a second, higher, position or level.

Some examples of bottling systems that may possibly be utilized or possibly adapted for use in at least one possible embodiment of the present application may possibly be found in the following U.S. patents, all assigned to the Assignee herein, namely: U.S. Pat. No. 4,911,285; No. 4,944,830; No. 4,950,350; No. 4,976,803; No. 4,981,547; No. 5,004,518; No. 5,017,261; No. 5,062,917; No. 5,062,918; No. 5,075,123; No. 5,078,826; No. 5,087,317; No. 5,110,402; No. 5,129,984; No. 5,167,755; No. 5,174,851; No. 5,185,053; No. 5,217,538; No. 5,227,005; No. 5,413,153; No. 5,558,138; No. 5,634,500; No. 5,713,403; No. 6,276,113; No. 6,213,169; No. 6,189,578; No. 6,192,946; No. 6,374,575; No. 6,365,054; No. 6,619,016; No. 6,474,368; No. 6,494,238; No. 6,470,922; and No. 6,463,964.

The components disclosed in the various publications, disclosed or incorporated by reference herein, may possibly be used in possible embodiments of the present invention, as well as equivalents thereof.

Some examples of methods and apparatuses for closing bottles and containers and their components that may possibly be utilized or possibly adapted for use in at least one possible embodiment of the present may possibly be found in the following U.S. patents: U.S. Pat. No. 5,398,485 issued to Osifchin on Mar. 21, 1995; U.S. Pat. No. 5,402,623 issued to Ahlers on Apr. 4, 1995; U.S. Pat. No. 5,419,094 issued to Vander Bush, Jr. et al. on May 30, 1995; U.S. Pat. No. 5,425,402 issued to Pringle on Jun. 20, 1995; U.S. Pat. No. 5,447,246 issued to Finke on Sep. 5, 1995; and U.S. Pat. No. 5,449,080 issued to Finke on Sep. 12, 1995.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of filling machines that utilize electronic control devices to control various portions of a filling or bottling process and that may possibly be utilized or possibly adapted for use in at least one possible embodiment of the present application may possibly be found in the following U.S. patents: U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

The appended drawings in their entirety, including all dimensions, proportions and/or shapes in at least one embodiment of the invention, are accurate and are hereby included by reference into this specification.

Some examples of control systems which measure operating parameters and learn therefrom that may possibly be utilized or possibly adapted for use in at least one possible embodiment of the present application may possibly be found in the following U.S. patents: U.S. Pat. No. 4,655,188 issued to Tomisawa et al. on Apr. 7, 1987; U.S. Pat. No. 5,191,272 issued to Torii et al. on Mar. 2, 1993; U.S. Pat. No. 5,223,820, issued to Sutterlin et al. on Jun. 29, 1993; and U.S. Pat. No. 5,770,934 issued to Theile on Jun. 23, 1998.

German Patent Application No. DE P 103 14 634, filed on Mar. 28, 2003 and having inventor Herbert BERNHARD, is hereby incorporated as if set forth in its entirety herein.

Some examples of memories that may possibly be utilized or possibly adapted for use in at least one possible embodiment of the present application may possibly be found in the following U.S. Patents: U.S. Pat. No. 5,789,887 issued to Elischewski on Aug. 4, 1998; U.S. Pat. No. 5,453,736 issued to Noren on Sep. 26, 1995; U.S. Pat. No. 5,315,220 issued to Takimoto et al. on May 24, 1994; U.S. Pat. No. 4,994,724 issued to Hsu on Feb. 19, 1991; U.S. Pat. No. 4,498,033 issued to Aihara et al. on Feb. 5, 1985; and U.S. Pat. No. 4,328,540 issued to Matsuoka et al. on May 4, 1982.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of microprocessors that may possibly be utilized or possibly adapted for use in a possible embodiment of the present application may possibly be found in the following U.S. patents: U.S. Pat. No. 5,770,934 issued to Theile on Jun. 23, 1998; U.S. Pat. No. 5,653,056 issued to Stark on Aug. 5, 1997; U.S. Pat. No. 5,647,173, issued to Stark et al. on Jul. 15, 1997; U.S. Pat. No. 5,625,266 issued to Stark on Apr. 29, 1997; U.S. Pat. No. 5,479,151 issued to Lavelle et al. on Dec. 26, 1995; and U.S. Pat. No. 5,453,736 issued to Noren on Sep. 26, 1995.

All, or substantially all, of the components and methods of the various embodiments may be used with at least one embodiment or all of the embodiments, if more than one embodiment is described herein.

Some examples of open-loop control systems that may possibly be utilized or possibly adapted for use in at least one possible embodiment of the present application may possibly be found in the following U.S. patents: U.S. Pat. No. 5,770,934 issued to Theile on Jun. 23, 1998; U.S. Pat. No. 5,210,473 issued to Backstrand on May 11, 1993; U.S. Pat. No. 5,320,186 issued to Strosser et al. on Jun. 14, 1994; and U.S. Pat. No. 5,369,342 issued to Rudzewicz et al. on Nov. 29, 1994.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of closed-loop control circuits that may possibly be utilized or possibly adapted for use in at least one possible embodiment of the present application may possibly be found in the following U.S. patents: U.S. Pat. No. 5,770,934 issued to Theile on Jun. 23, 1998; U.S. Pat. No. 5,189,605 issued to Zuehlke et al. on Feb. 23, 1993; U.S. Pat. No. 5,223,072 issued to Brockman et al. on Jun. 29, 1993; and U.S. Pat. No. 5,252,901, issued to inventors Ozawa et al. on. Oct. 12, 1993.

All of the patents, patent applications and publications recited herein, and in the Declaration attached hereto, are hereby incorporated by reference as if set forth in their entirety herein.

Some examples of look up tables accessed by computers or microprocessors that may possibly be utilized or possibly adapted for use in at least one possible embodiment of the present application may possibly be found in the following U.S. patents: U.S. Pat. No. 5,284,116 issued to Richeson, Jr. on Feb. 8, 1994; U.S. Pat. No. 5,359,325 issued to Ford et al. on Oct. 25, 1994; and U.S. Pat. No. 5,371,537 issued to Bohan et al. on Dec. 6, 1994.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of databuses or databus systems that may possibly be utilized or possibly adapted for use in at least one possible embodiment of the present application may possibly be found in the following U.S. patents: U.S. Pat. No. 6,008,546 issued to Sage on Dec. 28, 1999; U.S. Pat. No. 5,978,193 issued to Kaaden on Nov. 2, 1999; U.S. Pat. No. 5,815,732 issued to Cooper et al. on Sep. 29, 1998; U.S. Pat. No. 5,507,001 issued to Nishizawa on Apr. 9, 1996; U.S. Pat. No. 5,402,423 issued to Van Kersen on Mar. 28, 1995; and U.S. Pat. No. 4,725,838 issued to Maschek et al. on Feb. 16, 1998.

The corresponding foreign patent publication applications, namely, Federal Republic of Germany Patent Application No. DE P 103 08 156.9, filed on Feb. 27, 2003, having inventor Herbert BERNHARD, and DE-OS 103 08 156, having inventor Herbert BERNHARD, and DE-PS 103 08 156, having inventor Hebert BERNHARD, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of interface arrangements that may possibly be utilized or possibly adapted for use in at least one possible embodiment of the present application may possibly be found in the following U.S. patents: U.S. Pat. No. 5,001,704 issued to Narup et al. on Mar. 19, 1991; U.S. Pat. No. 5,961,356 issued to Fekete on Oct. 5, 1999; U.S. Pat. No. 6,621,692 issued to Johnson et al. on Sep. 16, 2003; U.S.

Pat. No. 6,661,961 issued to Allen et al. on Dec. 9, 2003; U.S. Pat. No. 6,687,166 issued to Takahashi et al. on Feb. 3, 2004; and U.S. Pat. No. 6,687,779 issued to Sturm et al. on Feb. 3, 2004.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of rotation sensors that may possibly be utilized or possibly adapted for use in at least one possible embodiment of the present application may possibly be found in the following U.S. patents: U.S. Pat. No. 6,246,232 issued to Okamura on Jun. 12, 2001; U.S. Pat. No. 6,448,761 issued to Stumpe on Sep. 10, 2002; U.S. Pat. No. 6,474,162 to Voss et al. on Nov. 5, 2002; U.S. Pat. No. 6,498,481 issued to Apel on Dec. 24, 2002; U.S. Pat. No. 6,532,831 issued to Jin et al. on Mar. 18, 2003; and U.S. Pat. No. 6,672,175 issued to Jin et al. on Jan. 6, 2004.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of cylinder and piston assemblies that may possibly be utilized or possibly adapted for use in at least one possible embodiment of the present application may possibly be found in the following U.S. patents: U.S. Pat. No. 4,380,313 issued to Klaus et al. on Apr. 19, 1983; U.S. Pat. No. 4,524,677 issued to Ashman et al. on Jun. 25, 1985; U.S. Pat. No. 6,318,524 issued to Lutz et al. on Nov. 20, 2001; U.S. Pat. No. 6,223,649 issued to Beck et al. on May 1, 2001; U.S. Pat. No. 6,659,240 issued to Dernebo on Dec. 9, 2003; and U.S. Pat. No. 6,691,605 issued to Röllgårdh on Feb. 17, 2004.

The details in the patents, patent applications and publications may be considered to be incorporable, at applicant's option, into the claims during prosecution as further limitations in the claims to patentably distinguish any amended claims from any applied prior art.

Some examples of limit switches that may possibly be utilized or possibly adapted for use in at least one possible embodiment of the present application may possibly be found in the following U.S. patents: U.S. Pat. No. 4,916,265 issued to Luallen on Apr. 10, 1990; U.S. Pat. No. 5,864,103 issued to Koeppe, Jr. et al. on Jan. 26, 1999; U.S. Pat. No. 5,890,585 issued to Nakamura et al. on Apr. 6, 1999; U.S. Pat. No. 5,965,960 issued to Cowan et al. on Oct. 12, 1999; U.S. Pat. No. 6,518,528 issued to Nickerson et al. on Feb. 11, 2003; and U.S. Pat. No. 6,635,833 issued to Vignaud on Oct. 21, 2003.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

Some examples of pressure relief valves that may possibly be utilized or possibly adapted for use in at least one possible embodiment of the present application may possibly be found in the following U.S. patents: U.S. Pat. No. 5,904,618 issued to Lewis on May 18, 1999; U.S. Pat. No. 5,909,748 issued to LaCroix on Jun. 8, 1999; U.S. Pat. No. 6,026,848 issued to Huynh on Feb. 22, 2000; U.S. Pat. No. 6,036,169 issued to Wass on Mar. 14, 2000; U.S. Pat. No. 6,352,085 issued to Morita et al. on Mar. 5, 2002; and U.S. Pat. No. 6,510,867 issued to LaFleur on Jan. 28, 2003.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

Some examples of equipment for handling of compressed air that may possibly be utilized or possibly adapted for use in at least one possible embodiment of the present application may possibly be found in the following U.S. patents: U.S. Pat. No. 6,070,810 issued to Chen on Jun. 6, 2000; U.S. Pat. No. 6,109,309 issued to Dornier et al. on Aug. 29, 2000; U.S. Pat. No. 6,327,858 issued to Negro et al. on Dec. 11, 2001; U.S. Pat. No. 6,355,008 issued to Nakao on Mar. 12, 2002; U.S. Pat. No. 6,516,707 issued to Elberson on Feb. 11, 2003; and U.S. Pat. No. 6,543,475 issued to Colby on Apr. 8, 2003.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

There is suggested in one aspect, a lifting device, configured to perform a variable stroke, for container processing machines, particularly for machines for filling containers, with the lifting devices being disposed in circular manner and at a distance with respect to one another at the lifting device table, onto each lifting device is secured a support table, and each lifting device comprises a conduit, for a pressure medium, which conduit is guided into the chamber of the lifting device, and it is provided that at and/or within the lifting device there are provided abutment means which are configured to vary the stroke in conformity with the pressure exerted by the pressure medium.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A beverage bottling plant for filling bottles with a liquid beverage filling material, said beverage bottling plant comprising:

a filling machine being configured to fill empty bottles with liquid beverage filling material;

a conveyer arrangement being configured and disposed to move empty bottles to said filling machine;

said filling machine comprising a rotor having a peripheral portion;

said filling machine defining a vertical axis about which said rotor is configured to rotate;

said beverage filling machine comprising a plurality of beverage filling positions disposed about said peripheral portion of said rotor;

each beverage filling position comprising a beverage filling device for filling bottles with liquid beverage filling material;

each filling device comprising apparatus being configured to introduce a predetermined volume of liquid beverage filling material into the interior of bottles to a substantially predetermined level of liquid beverage filling material;

said apparatus being configured to introduce a predetermined volume of liquid beverage filling material comprising apparatus being configured to terminate the filling of beverage bottles upon liquid beverage filling material reaching said substantially predetermined level in bottles;

each filling position comprising a support configured and disposed to maintain a bottle in a predetermined position for filling by a corresponding filling device;

each filling position comprising an arrangement to seal a bottle for filling a bottle with an effervescent beverage;

apparatus being configured to raise and to lower said bottle support and a bottle supported thereby;

said apparatus being configured to raise and lower said bottle support comprising:

a rod having a first, lower, end and a second, upper, end remote from said lower end;

said lower end of said rod being secured to said rotor of said filling machine;

a cylinder having a longitudinal axis and having outer and inner walls disposed about the longitudinal cylinder axis;

said inner cylinder wall being configured and disposed to slide on said rod to permit up-and-down movement of said cylinder;

said cylinder having a first, upper, end and a second, lower, end remote from said upper end of said cylinder;

said bottle support being secured to said upper end of said cylinder to permit raising and lowering of said bottle support and a bottle supported thereby;

a collar secured to said lower end of said cylinder;

a first, upper, stop structure secured to said rotor of said filling machine adjacent said upper end of said rod;

said cylinder outer wall being configured to slide within said upper stop structure;

a second, lower, stop structure operatively connected to said upper stop structure and being configured and disposed to slide on said outer cylinder wall;

a spring disposed between said upper stop structure and said lower stop structure and being configured to be compressed between said upper stop structure and said lower stop structure;

said rod comprising a longitudinal bore configured to permit passage of a pressure medium from said lower end of said rod into said cylinder;

said cylinder being configured to be raised by a first, lower, pressure of a pressure medium passing through said longitudinal bore of said rod and thus raising said bottle support and a bottle supported thereby to a first, lower, position being a position in which a bottle is disposed remote from said seal arrangement which lower position is configured for filling of a bottle with a still beverage;

said cylinder being configured to be raised by a second pressure, being a pressure higher than the first pressure, of a pressure medium passing through said longitudinal bore of said rod and thus raising said bottle support and a bottle supported thereby to a second, higher, position being a position in which a bottle is sealed to said sealing arrangement which higher position is configured for filling of a bottle with an effervescent beverage;

said collar being configured to be disposed against said lower stop structure to maintain said bottle support and a bottle supported thereby in the lower position upon the lower pressure being applied in said cylinder;

said spring being configured and disposed to be compressed between said upper stop structure and said lower stop structure by said collar upon the higher pressure being applied in said cylinder to permit raising of said bottle support and a bottle supported thereby to the higher position.

2. The beverage bottling plant for filling bottles with a liquid beverage filling material according to claim 1, wherein:

said spring comprises at least one coil spring.

3. The beverage bottling plant for filling bottles with a liquid beverage filling material according to claim 2, wherein:

said at least one coil spring comprises one of: plastic and, metal.

4. A beverage bottling plant for filling bottles with a liquid beverage filling material, said beverage bottling plant comprising:

a filling machine being configured to fill empty bottles with liquid beverage filling material;

a conveyer arrangement being configured and disposed to move empty bottles to said filling machine;

said filling machine comprising a rotor having a peripheral portion;

said filling machine defining a vertical axis about which said rotor is configured to rotate;

said beverage filling machine comprising a plurality of beverage filling positions disposed about said peripheral portion of said rotor;

each beverage filling position comprising a beverage filling device for filling bottles with liquid beverage filling material;

each filling device comprising apparatus being configured to introduce a predetermined volume of liquid beverage filling material into the interior of bottles to a substantially predetermined level of liquid beverage filling material;

said apparatus being configured to introduce a predetermined volume of liquid beverage filling material comprising apparatus being configured to terminate the filling of beverage bottles upon liquid beverage filling material reaching said substantially predetermined level in bottles;

each filling position comprising a support configured and disposed to maintain a bottle in a predetermined position for filling a by a corresponding filling device;

apparatus being configured to raise and to lower said bottle support and a bottle supported thereby, said lifting apparatus comprising:

a chamber configured to receive a pressure medium;

a stop structure being configured to permit a plurality of stroke lengths of said lifting apparatus depending upon the pressure exerted by the pressure medium in said chamber to raise said bottle support and a bottle supported by said bottle support, adjacent a filling device, to at least two predetermined levels.

5. The beverage bottling plant according to claim 4, comprising:

a conduit, for the pressure medium, which conduit is connected to said chamber configured to receive a pressure medium.

6. The beverage bottling plant according to claim 5, comprising:

a biasing member operatively connected to said stop structure;

said stop structure is configured and disposed to compress said biasing member to permit raising of said bottle support and a bottle supported thereby to at least two predetermined levels.

7. The beverage bottling plant according to claim 6, wherein:

said stop structure comprises a structure configured to receive said biasing member.

8. The beverage bottling plant according to claim 7, wherein:

said chamber is configured to receive a first pressure of the pressure medium to raise said bottle support and a bottle supported thereby to a first level and to receive a second, higher, pressure of the pressure medium to raise said bottle support and a bottle supported thereby to a second, higher, level.

9. The beverage bottling plant according to claim 8, wherein:

said biasing member comprises at least one of: (a) and (b), wherein (a) and (b) comprise:

(a) a spring; and (b) a structure configured to be actuated by at least one of: a hydraulic pressure and a pneumatic pressure.

10. The beverage bottling plant according to claim 9, wherein:

said spring comprises at least one coil spring.

11. The beverage bottling plant according to claim 10, wherein:

said stop structure is configured to contain at least a portion of said at least one coil spring.

12. The beverage bottling plant according to claim 11, wherein:

said at least one coil spring comprises one of: plastic and, metal.

13. A container filling plant container lifting apparatus configured to raise and to lower a container support and a container supported thereby in a container filling machine having a plurality of filling elements, said lifting apparatus comprising:

a chamber being configured to receive a first pressure of a pressure medium to raise said container support and a container supported thereby to a first level;

said chamber being configured to receive a second pressure of the pressure medium to raise said container support and a container supported thereby to a second level;

said first pressure being different from said second pressure, and said first level being different from said second level; and a stop structure being configured to permit a plurality of different stroke lengths of said lifting apparatus depending upon the pressure exerted by the pressure medium in said chamber to raise said container support and a container supported by said container support, adjacent a filling element, to at least two predetermined levels.

14. The container filling plant container lifting apparatus according to claim 13, wherein:

said chamber is configured to receive the first pressure of the pressure medium to raise said container support and a container supported thereby to said first level to dispose a mouth of the container a distance from a filling element for a counterpressure-free, free jet filling of the container; and said chamber is configured to receive the second pressure of the pressure medium to raise said container support and a container supported thereby to said second level to dispose a mouth of the container in sealed contact with a filling element for a counterpressure filling of the container.

15. The container filling plant container lifting apparatus according to claim 14, wherein:

said second pressure is higher than said first pressure; and said lifting apparatus comprises a conduit, for a pressure medium, which conduit is connected to said chamber configured to receive a pressure medium.

16. The container filling plant container lifting apparatus according to claim 15, comprising:

a biasing member operatively connected to said stop structure;

said stop structure is configured and disposed to compress said biasing member to permit raising of said container support and a container supported thereby to at least two predetermined levels.

17. The container filling plant container lifting apparatus according to claim 16, wherein:

said stop structure comprises a structure configured to receive said biasing member.

18. The container filling plant container lifting apparatus according to claim 17, wherein:

said biasing member comprises at least one of: (a) and (b), wherein (a) and (b) comprise:

(a) a spring; and (b) a structure configured to be actuated by at least one of: a hydraulic pressure and a pneumatic pressure.

19. The container filling plant container lifting apparatus according to claim 18, wherein:

said spring comprises at least one coil spring.

20. The container filling plant container lifting apparatus according to claim 19, wherein:

said stop structure is configured to contain at least a portion of said at least one coil spring;

said at least one coil spring comprises one of: plastic and, metal.

* * * * *